US006883670B2

(12) United States Patent
Moon

(10) Patent No.: US 6,883,670 B2
(45) Date of Patent: Apr. 26, 2005

(54) HORIZONTALLY EXTENDIBLE GUARD FOR RESTRICTING ACCESS TO A RACK OF GOODS

(76) Inventor: John Paul Moon, 4407 Woodfield Dr., Hahira, GA (US) 31632

( * ) Notice: Subject to any disclaimer, the term of this patent is extended or adjusted under 35 U.S.C. 154(b) by 3 days.

(21) Appl. No.: 10/601,533

(22) Filed: Jun. 24, 2003

(65) Prior Publication Data

US 2004/0262247 A1 Dec. 30, 2004

(51) Int. Cl.[7] ..... A47B 73/00
(52) U.S. Cl. ..... 211/74; 211/4; 211/88.02; 211/175
(58) Field of Search ..... 211/4, 7, 8, 183, 211/175, 105.3, 208, 201, 105, 74, 90.02, 211/88.02; 248/551; 70/77, 78; 108/137, 108/102; 312/114, 118, 122, 350

(56) References Cited

U.S. PATENT DOCUMENTS 982,477 A * 1/1911 Cavanagh ..... 211/30
5,123,665 A * 6/1992 Levy ..... 280/35
5,332,105 A 7/1994 Stanfield
5,513,580 A 5/1996 Franks
5,660,637 A * 8/1997 Dodge ..... 118/500
6,138,483 A 10/2000 Galant
6,139,034 A 10/2000 Williams
6,205,823 B1 3/2001 Volk, Sr.
6,382,434 B1 * 5/2002 Silberg ..... 211/195
6,409,025 B1 6/2002 Moon
6,422,405 B1 * 7/2002 Haenszel ..... 211/175

* cited by examiner

*Primary Examiner*—Jennifer E. Novosad
(74) *Attorney, Agent, or Firm*—Roberts, Mlotkowski & Hobbes; Laurence P. Hobbes

(57) ABSTRACT

A guard for restricting access to a rack of goods comprises: an access-restricting horizontally expandable cover having an open bottom, a left side to which is mounted a track, and a right side to which is mounted a track; a left extensible member comprising a track which is lockably engageable with the track of said left side so as to slide said left extensible member from a retracted storage position to an extended use position; a right extensible member comprising a track which is engageable with the track of said right side so as to slide said right extensible member from a retracted storage position to an extended use position; and a horizontally expandable bottom member having a left end securable to a lower end of said left extensible member, and a right end securable to a lower end of said right extensible member.

24 Claims, 1 Drawing Sheet

HORIZONTALLY EXTENDIBLE GUARD FOR RESTRICTING ACCESS TO A RACK OF GOODS

BACKGROUND OF THE INVENTION

A. Field of the Invention

The present invention relates to a guard for restricting access to a rack of goods. The guard is especially suited to prevent unauthorized removal of bottles from a rack and can be adapted to cover racks of various horizontal dimensions.

B. Background of the Invention

Pilferage losses can substantially affect the profitability of retail businesses. This is especially true in food and beverage service industries where constant monitoring of employees can be difficult. Unauthorized access or even the threat of such access in a retail establishment can necessitate repeated inventorying of stock to detect and deter losses of inventory, especially losses occurring after business hours when management presence is reduced. In restaurant or bar businesses costly measures are often taken to secure inventories of alcoholic beverages. Often, such businesses secure their inventory sifting in wells at the bar after hours by putting up liquor bottles in a separate location which is securable, e.g., a locked cage. However, there are disadvantages associated with these precautions, e.g., handling costs and associated breakage, as well as a need for increased secured storage space. Accordingly, it would be useful to secure inventory from its site of dispensation, e.g., liquor bottles at the bar.

Various efforts have been made in the past to reduce the opportunity to pilfer inventory. For example, U.S. Pat. No. 6,139,034 to Williams discloses a food service cart for airplanes with a vertically slidable latching mechanism for its doors which is securable by a padlock. U.S. Pat. No. 5,513,580 to Franks discloses a lockbox or safe which comprises extensions which are expandable or retractable when the box is open which serve to secure the box in a confined space. U.S. Pat. No. 6,409,025 to Moon discloses a guard which restricts access to bottles in a well which is a self-contained, stand-alone device which does not require any modification to a platform, say, a well, for holding bottles, e.g., by adding attachment points to the sides of the well. The guard is further secured along the underside of the platform or well and can be extended by vertically mounted tracks on either side to which extensible members are lockably engaged.

All of the above references are incorporated herein by reference in their entirety.

In applications where a guard is desired to cover a variety of different platforms, e.g., of various widths, it would be useful to provide a guard which is horizontally extendible. Such a feature would also permit improved ease of storage for the guard.

SUMMARY OF THE INVENTION

In one aspect, the present invention relates to a guard for restricting access to a rack of goods which comprises:

- a horizontally expandable access-restricting cover having an open bottom, a left side to which is mounted a track means, and a right side to which is mounted a track means;
- a left extensible member comprising a track means which is engageable with the track means of said left side so as to slide in a substantially vertical direction said left extensible member from a retracted storage position to an extended use position;

- a right extensible member comprising a track means which is engageable with the track means of said right side so as to slide in a substantially vertical direction said right extensible member from a retracted storage position to an extended use position; and
- a horizontally expandable bottom member having a left end securable to a lower end of said left extensible member, and a right end securable to a lower end of said right extensible member.

In one embodiment of the present invention, the horizontally expandable access-restricting cover comprises a horizontally telescoping structural unit comprising at least two telescoping members, e.g., at least three telescoping members. The telescoping members can be of any suitable shape, including cylindrical and rectangular, e.g., comprising box tubing.

In another embodiment, the horizontally expandable bottom member comprises a horizontally telescoping structural unit comprising at least two telescoping members, e.g., at least three telescoping members.

In still another embodiment, the horizontally expandable bottom member comprises a central member in a nestable relationship with a left slidable plate and a right slidable plate whose distal ends are securable to the lower end of the left extensible member and the lower end of the right extensible member, respectively. The central member can be a plate comprising folded over edges which provide a track in which the left slidable plate and the right slidable plate can be nested. The left slidable plate and the right slidable plate can each comprise a longitudinal slot and the central member can comprise a left hole and a right hole in alignment with the respective longitudinal slots, through each of which holes can be placed a bolt securable with a nut, so as to fix the slidable plates in relation to the central member.

In another embodiment of the guard of the present invention, at least one of the side-mounted track means comprises at least one pin including a shaft and a head and the extensible member associated with the side-mounted track means comprises a track means including a longitudinal slot whose width exceeds the largest cross-sectional dimension of the shaft and is less than the width of the head, the extensible member being positioned between the side member and the head such that the shaft of the pin is located within the slot and the extensible member is secured to the side by the head, such that the extensible member can be extended in at least a downward direction.

In another embodiment of the present invention, each of the side-mounted track means comprises at least two of the pins, e.g., three or more pins arranged in a substantially straight line along each side.

In still another embodiment, a buffer surface is attached between each side and each extensible member to reduce friction between same. The buffer surface can comprise any suitable friction-reducing material e.g., one selected from the group comprising nylon and polytetrafluoroethylene.

In yet another embodiment, the bottom member is securable to at least one of the extensible members by any suitable reversibly securing means, e.g., one that is selected from the group consisting of padlock and hasp, deadbolt, and cam lock.

In still yet another embodiment, the cover is shaped to conform to a terraced arrangement of goods, e.g., a terraced arrangement of bottles.

In another embodiment, the bottom of the left side and the bottom of the right side each comprises a channel adapted to fit onto a surface of the rack on which the guard is mounted.

The channel can be padded to prevent direct contact of the channel with the rack, e.g,. using a suitable padding material, such as rubber or plastic.

In still another embodiment, a) the outer ends of the telescoping members, e.g., those ends attached to the sides, are capped and/or b) each junction of the interior ends of the telescoping members is collared to increase friction between the interior ends of each junction. The outer ends of the telescoping members can be each capped with a plastic cap and each junction of the interior ends of the telescoping members can be collared with a plastic collar, which can increase friction between said interior ends.

In another aspect, the present invention relates to a guard for securing a rack of goods which comprises:

an access-restricting left vertical side member to which is mounted an engageable track means;

an access-restricting right vertical side member to which is mounted an engageable track means;

an access-restricting front member at least partially disposed between or upon, and attachable to, the side members;

an access-restricting rear member at least partially disposed between or upon, and attachable to, the side members;

an access-restricting upper member at least partially disposed between or upon, and attachable to, the side members;

a left extensible member comprising a track means which is engageable with the track means of the left vertical side member to permit sliding in a substantially vertical direction the left extensible member from a retracted storage position to an extended use position;

a right extensible member comprising a track means which is engageable with the track means of the right vertical side member to permit sliding in a substantially vertical direction the right extensible member from a retracted storage position to an extended use position;

a bottom member having a left end securable to the lower end of the left extensible member, and a right end securable to the lower end of the right extensible member; and further wherein the front member, the rear member, the upper member and the bottom member are horizontally expandable.

In yet another aspect, the present invention relates to a securable bottle storage system which comprises:

a rack comprising a floor, capable of receiving at least one row of upright standing bottles;

a lockable guard securable over the rack which comprises an access-restricting horizontally expandable cover having an open bottom, a left side to which is mounted a track means, and a right side to which is mounted a track means;

a left extensible member comprising a track means which is lockably engageable with the track means of the left side so as to slide the left extensible member from a retracted storage position to an extended use position;

a right extensible member comprising a track means which is lockably engageable with the track means of the right side so as to slide the right extensible member from a retracted storage position to an extended use position; and a horizontally expandable bottom member having a left end securable to a lower end of the left extensible member, and a right end securable to a lower end of the right extensible member, the bottom member locatable beneath the floor of the rack.

BRIEF DESCRIPTION OF THE DRAWINGS

This invention, and the advantageous features thereof, will be more completely understood when considered in context with the following detailed description, which includes a description of the attached drawing, wherein.

DETAILED DESCRIPTION OF THE INVENTION

Figures 1, 2:
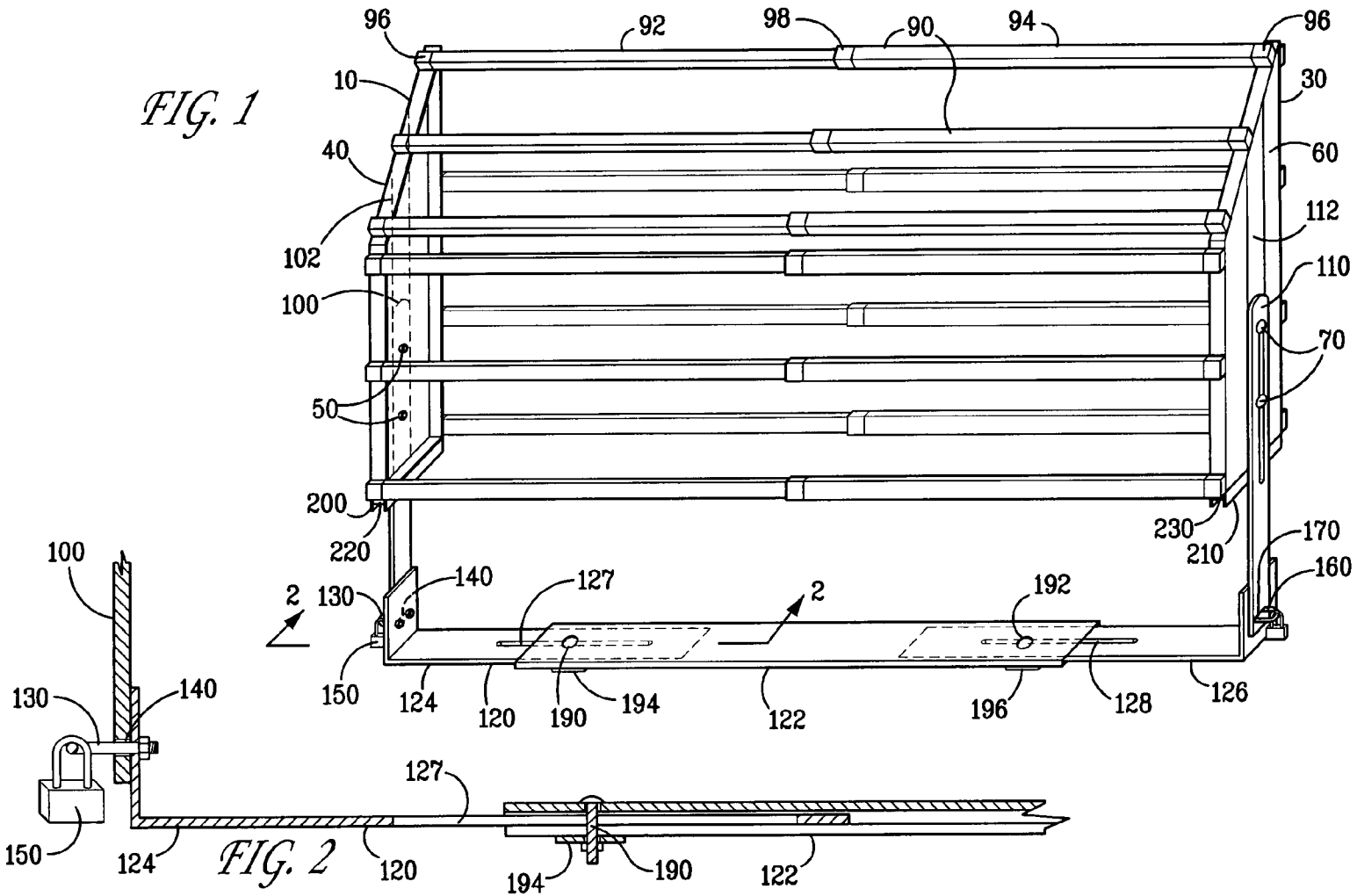
FIG. 1 illustrates a perspective view of an embodiment of the invention in its extended use configuration.
FIG. 2 illustrates an enlarged partial longitudinal cross-section view of the left side of the horizontally extendable bottom member used in the guard of the present invention.

Although the present invention is particularly useful and described in connection with the storage of liquor bottles, it will be apparent that it can be used for the protected storage of any type of bottles or other items which are placed in a floored holder or rack.

The guard of the present invention prevents unauthorized access to goods, e.g., opened bottles of liquors by employees and ancillary personnel such as cleaning crews. The present invention provides a means to secure bottles where they sit in their wells at a bar, removing the need to put up the bottles in a separate, secured location.

FIG. 1 illustrates a frontal perspective view of an embodiment of the present invention in the extended configuration employed when in use.

FIG. 2 provides a more detailed perspective view of the horizontally expandable bottom member employed in the present invention.

The FIGURES are described in greater detail below.

FIG. 1 depicts a guard 10 of the present invention which can be set in place over a well which can act as a rack for goods such as liquor bottles (not shown). The well can be tiered or untiered, with the guard of FIG. 1 being angled to conform to a tiered (or terraced) well. The guard comprises an access-restricting cover 30 having an open bottom, a left side member 40 to which is mounted a left track means 50, and a right side member 60 to which is mounted a right track means 70. These track means can comprise a single bolt or vertically aligned plural bolts, e.g., two bolts.

Securably attached to the exposed top, front and optionally, rear surfaces of the side members are horizontally extendable access-restricting elements 90 which impart horizontal expandability to the cover. These elements should be spaced sufficiently apart to restrict access to an interior space within the guard in order to prevent withdrawal of goods through the guard.

The access-restricting elements 90 can be any suitable members which are horizontally expandable, for example, structural units comprising a scissor gate, or structural units comprising at least partially nesting members, e.g., telescoping members, drawer slides, etc. Structural units comprising telescoping members contain at least two telescoping members, e.g., three or more. The telescoping members can be of any suitable diameter and length depending on the extended and collapsed lengths required, as can be determined by one of skill in the art. The telescoping members can be of serially decreasing (or increasing) diameters which provide for a potentially completely collapsible structure (in which one member is telescoped completely within another), or of alternating diameters which provides a partially collapsible structure. Such telescoping members can be incorporated in the access-restricting cover as a plurality of expandable stringers, each comprising, e.g., an inner telescoping member 92 and an outer telescoping member 94. Optionally, intermediate telescoping members can be deployed providing a structural unit of 3 or more telescoping units. Each telescoping member can be of suitable construction, e.g., outer members being hollow whilst the innermost member is hollow or solid. The telescoping members can be closed tubes of the same type of cross-section, e.g., circular, elliptical, rectangular, e.g., square (box tubing), etc. Alternately, the telescoping members can comprise a partially open structure providing a groove, and an elongated plate that can slide within the groove. The telescoping members can be made of any suitable material of sufficient strength, including wood, metal, e.g., aluminum or stainless steel, plastic, e g., vinyl, or fiberglass. Aluminum of 14 gauge thickness has been found to be particularly suitable.

When extended in use, the structural units comprising telescoping members should be extended only to the extent to which the structural unit remains stable, e.g., an overlap of at least about 6 inches, say about 8 inches should be maintained between telescoping members.

The outermost ends of the horizontally expandable structural units are secured to the inner surfaces of their respective side members by any suitable method, e.g., with wood screws in a wooden construction, sheet metal screws or bolts, e.g., one-way bolts, for a metal construction, or by welding for a plastic construction. The outermost ends of the structural units can also be provided with caps 96 capped with a suitable material, e.g., plastic, e.g., vinyl, rubber, etc. to cover exposed end surfaces for safety or aesthetic purposes. The interior ends of each structural unit, e.g., junctions of telescoping members, can be collared or booted for similar reasons with collars or boots 98 of such material, as well as to provide increased friction between the cooperating telescoping members.

A left extensible member 100 comprises a track means which is engageable with the track means of the left side 50 so as to slide the left extensible member from an upward retracted storage position to a downward extended use position, relative to the left side. Similarly, a right extensible member 110 comprises a track means, engageable with the track means of the right side 70 so as to slide said right extensible member from an upward retracted storage position to a downwardly extended use position, relative to the right side. Each extensible member can comprise a track means mounted on a separate reinforcing member (not shown) which imparts further strength to the guard. The guard can also comprise stop means (not shown), if necessary, which limits extension of the extensible members.

In the embodiment of the invention depicted in FIG. 1, the left extensible member 100 is a longitudinally slotted piece which is mounted between the outer surface of the left side 40 and the head of the bolt(s) associated with the left track means 50. Each bolt (except for the head) passes through the slot into the side member 40, while the head of the bolt abuts the slot which secures the left extensible member 100 to the left side 40 while at the same time permitting a sliding movement of the left extensible member 100 along the slot relative to the left side 40. Where more than one bolt per side is used, aligned bolts can provide for movement of the left extensible member 100 in a straight line. A left friction-reducing surface 102 can be installed between the left side 40 and the left extensible member 100 to improve slidability.

In the embodiment of the invention depicted in FIG. 1, the right extensible member 110 is a longitudinally slotted piece which is mounted between the outer surface of the right side 60 and the head of the bolt(s) associated with the right track means 70. Each bolt (except for the head) passes through the slot into the right side member 60, while the head of the bolt abuts the slot which secures the right extensible member 110 to the right side 60 while at the same time permitting a sliding movement of the right extensible member 60 along the slot relative to the right side 60. Where more than one bolt per side is used, aligned bolts can provide for movement of the right extensible member 110 in a straight line. A right friction-reducing surface 112 can be installed between the right side 60 and the right extensible member 110 to improve slidability.

Generally, the combined extensible members 100 and 110 and track means 50 and 70 can be any suitable cooperating sliding, leaved, or telescoping combination capable of linear movement, with the above-described bolt/slotted piece combination being among the simplest. Alternatives include, e.g., a drawer slide assembly which can be mounted to impart the desired extensibility to the guard of the present invention. Examples of suitable drawer slide assemblies for use in the present invention include Models 3832B, 3834B, or 3837B 32MM Full Extension Drawer Slide available from Accuride International, Inc. of Santa Fe Springs, Calif. In instances where a disconnect lever is exposed and accessible in the drawer slide combination as installed, it would be desirable to remove or otherwise disable such disconnecting means in order to prevent removal of the extensible member from the installed track means which defeats the purpose of the present invention by permitting unauthorized removal of the guard of the present invention.

A horizontally expandable bottom member 120 has permanently mounted at its left end a securing means 130 such as a staple or U-bolt, securable to the left extensible member 100 through a latitudinal slot 140 positioned at the lower end of the left extensible member through which the securing means, e.g., staple, can protrude. A left locking means 150 such as a padlock can be passed through the securing means, e.g., staple, that protrudes through the slot 140 to secure the bottom member to the left extensible member.

Similarly, the horizontally expandable bottom member 120 has permanently mounted at its right end a securing means 160 such as a staple or U-bolt, securable to the right extensible member 110 through a latitudinal slot 170 positioned at the lower end of the right extensible member through which the staple can protrude. A right locking means 180 such as a padlock can be passed through the securing means, e.g., staple that protrudes through the slot 170 to secure the bottom member to the right extensible member.

In any event, this configuration provides a reversibly securable means for connecting the extensible members to the bottom member which is positioned underneath the rack or well which holds the goods to be secured. Suitable means for reversibly securing the bottom member to the extensible members can include means selected from the group consisting of padlock and hasp, deadbolt, and cam lock.

The horizontally expandable bottom member 120 can comprise a central member 122 which contains a groove in which a left slidable plate 124 and a right slidable plate 126 can slide. Movement of the slidable plates within the central member can be prevented while providing some adjustability by providing longitudinal slots 127 and 128 through which bolts 190 and 192 can be passed. The bolts can be secured with nuts 194 and 196 on the opposite side of holes provided in the central member 122. This allows for linear movement of the slidable plates when the bolts are loosened and fixes the horizontally expandable bottom member to a specific length when the bolts are tightened.

FIG. 2, depicts a detailed partial longitudinal cross-section view of the left side of the horizontally extendable bottom member 120 which is explained, supra.

To assist in setting the guard onto the rack, the bottom of the left side 40 and right side 60 can be modified by securing a left channel 200 and a right channel 210 which are adapted to fit onto surfaces of the rack on which the guard is placed. The channels are secured to the side bottoms by any suitable means such as screws, welding, etc. Inside the channel can be placed suitable padding such as rubber or plastic seals or padding 220 and 230. The channels can be of any suitable width depending on the rack characteristics, typically about one inch in width.

The guard of the present invention can assume any shape necessary to protect the goods as stored and used. The cover of the guard can be shaped to conform to a terraced arrangement of goods or a terraced arrangement of bottles as are commonly employed in bars and restaurants.

While the invention has been described herein in terms of various preferred embodiments, those skilled in the art will recognize that various changes and modifications can be made without departing from the spirit and scope of the invention, as defined in the following claims.

What is claimed is:

1. A guard for restricting access to a rack of goods which comprises:

a horizontally expandable access-restricting cover having an open bottom, a left side to which is mounted a track means for engaging, and a right side to which is mounted a track means for engaging;

a left extensible member comprising a track means for engaging which is engageable with the track means for engaging of said left side se as to slide, in a substantially vertical direction, said left extensible member from a retracted storage position to an extended use position;

a right extensible member comprising a track means for engaging which is engageable with the track means for engaging of said right side so as to slide, in a substantially vertical direction, said right extensible member from a retracted storage position to an extended use position; and a horizontally expandable bottom member having a left end securable to a lower end of said left extensible member, and a right end securable to a lower end of said right extensible member.

2. The guard of claim 1 wherein said horizontally expandable access-restricting cover comprises a horizontally telescoping structural unit comprising at least two telescoping members.

3. The guard of claim 2 wherein said telescoping members are cylindrical.

4. The guard of claim 2 wherein said telescoping members are rectangular.

5. The guard of claim 4 wherein said telescoping members comprise box tubing.

6. The guard of claim 2 wherein a) the outer ends of the telescoping members are capped and/or b) each junction of the interior ends of the telescoping members is collared to increase friction between the interior ends of each junction.

7. The guard of claim 6 wherein the outer ends of the telescoping members are each capped with a plastic cap and each junction of the interior ends of the telescoping members is collared with a plastic collar.

8. The guard of claim 1 wherein said horizontally expandable access-restricting cover comprises a horizontally telescoping structural unit comprising at least three telescoping members.

9. The guard of claim 1 wherein said horizontally expandable bottom member comprises a horizontally telescoping structural unit comprising at least two telescoping members.

10. The guard of claim 1 wherein said horizontally expandable bottom member comprises a horizontally telescoping structural unit comprising at least three telescoping members.

11. The guard of claim 10 wherein said horizontally expandable bottom member comprises a central member in a nestable relationship with a left slidable plate and a right slidable plate whose distal ends are securable to said lower end of said left extensible member and said lower end of said right extensible member, respectively.

12. The guard of claim 11 wherein said central member is a plate comprising folded over edges which provide a track in which said left slidable plate and said right slidable plate can be nested.

13. The guard of claim 12 in which said left slidable plate and said right slidable plate each comprise a longitudinal slot and said central member comprises a left hole and a right hole in alignment with said respective longitudinal slots, through each of which holes is placed a bolt secured with a nut, so as to fix said slidable plates in relation to said central member.

14. The guard of claim 1 wherein at least one of said side-mounted track means for engaging comprises at least one pin including a shaft and a head and said extensible member associated with said side mounted track means for engaging includes a longitudinal slot whose width exceeds the largest cross-sectional dimension of said shaft and is less than the width of said head, said extensible member being positioned between said side member and said head such that the shaft of said pin is located within said slot and said extensible member is secured to said side by said head, such that the extensible member can be extended in at least a downward direction.

15. The guard of claim 14 wherein each said side-mounted track means for engaging comprises at least two of said pins.

16. The guard of claim 14 wherein a buffer surface is attached between each side and each said extensible member to reduce friction between same.

17. The guard of claim 16 wherein said buffer surface is selected from the group comprising nylon and polytetrafluoroethylene.

18. The guard of claim 1 wherein said bottom member is securable to at least one of said extensible members by a reversibly securing means which is selected from the group consisting of padlock and hasp, deadbolt, and cam lock.

19. The guard of claim 1 wherein said bottom member is reversibly securable to at least one of said extensible members by a reversibly securing means which comprises padlock and hasp.

20. The guard of claim 1 wherein said cover is shaped to conform to a terraced arrangement of goods.

21. The guard of claim 1 wherein said cover is shaped to conform to a terraced arrangement of bottles.

22. The guard of claim 1 wherein the bottom of said left side and the bottom of said right side each comprises a channel adapted to fit onto a surface of said rack.

23. The guard of claim 22 wherein said channel is padded.

24. A guard for securing a rack of goods which comprises:

an access-restricting left vertical side member to which is mounted an engageable track means for engaging;

an access-restricting right vertical side member to which is mounted an engageable track means for engaging;

an access-restricting front member at least partially disposed between or upon, and attachable to, said side members;

an access-restricting rear member at least partially disposed between or upon, and attachable to, said side members;

an access-restricting upper member at least partially disposed between or upon, and attachable to, said side members;

a left extensible member comprising a track means for engaging which is engageable with the track means for engaging of said left vertical side member to permit sliding, in a substantially vertical direction, said left extensible member from a retracted storage position to an extended use position;

a right extensible member comprising a track means for engaging which is engageable with the track means for engaging of said right vertical side member to permit sliding, in a substantially vertical direction, said right extensible member from a retracted storage position to an extended use position;

a bottom member having a left end securable to the lower end of said left extensible member, and a right end securable to the lower end of said right extensible member and further wherein said front member, said rear member, said upper member and said bottom member are horizontally expandable.

* * * * *